US005197158A

United States Patent [19]

Moini

[11] Patent Number: 5,197,158

[45] Date of Patent: Mar. 30, 1993

[54] SWIMMING POOL CLEANER

[75] Inventor: Siamak Moini, Encino, Calif.

[73] Assignee: Philip L. Leslie, Tarzana, Calif.

[21] Appl. No.: 864,641

[22] Filed: Apr. 7, 1992

[51] Int. Cl.[5] ..... E04H 3/20

[52] U.S. Cl. ..... 15/1.7; 15/387

[58] Field of Search ..... 15/1.7, 387

[56] References Cited

U.S. PATENT DOCUMENTS

| | | | |
|---|---|---|---|
| 3,229,315 | 1/1966 | Watson | 15/1.7 |
| 4,449,265 | 5/1984 | Hoy | 15/1.7 |
| 4,560,418 | 12/1985 | Raubenheimer | 15/1.7 |
| 5,001,800 | 3/1991 | Parenti | 15/1.7 |

*Primary Examiner*—Edward L. Roberts
*Attorney, Agent, or Firm*—Philip D. Junkins

[57] ABSTRACT

A vacuum powered automatic swimming pool cleaning device having a hollow housing supported on two pairs of device mover wheels. The housing includes a central water suction chamber in water flow communication with a water suction trough at the bottom of the housing and in water outlet communication with an external vacuum line, a gear train for driving one of the pairs of mover wheels, and pivoted directional control floats. The water suction chamber houses an axle mounted turbine wheel bearing water driven vanes with the turbine being rotated in one direction only by water flow through the chamber. The turbine axle bears a turbine power output drive gear which intermeshes with one or the other of two shift gears which in turn reversibly drive the gear train as dictated by the position of the directional control floats within the housing. The floats swing shift within the housing to shift the shift gears in response to the impact of the cleaning device on an obstruction on the pool floor or by the device impacting a vertical pool wall. The swing shift of the control floats reverses the rotation of the mover wheels and thus the direction of movement of the cleaning device on the pool floor.

16 Claims, 4 Drawing Sheets

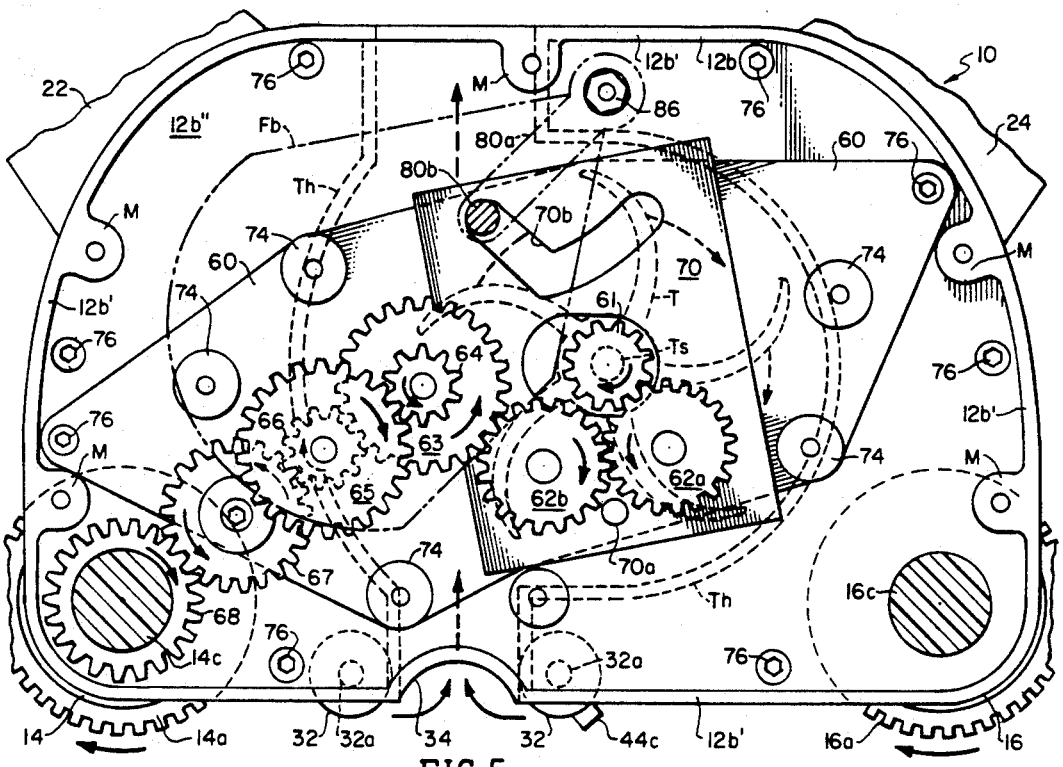
FIG. 5.
FIG. 6.
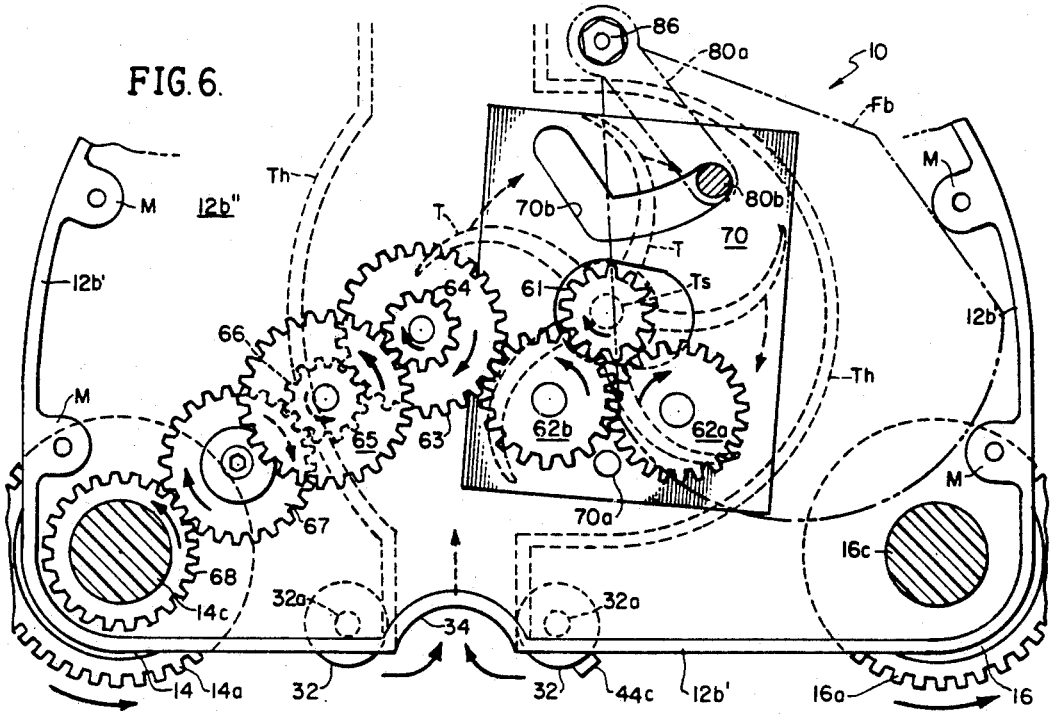

SWIMMING POOL CLEANER

BACKGROUND OF THE INVENTION

1. Field of the Invention

The present invention relates to an automatic vacuum powered cleaner for cleaning the bottom and side walls of a swimming pool. More particularly, the invention relates to a swimming pool cleaning device comprised of a car adapted to travel underwater along a random path on the bottom and to climb the side walls of a swimming pool.

2. Description of the Prior Art

Swimming pool cleaning for many years was a laborious hand operation typically accomplished by manipulating a vacuum head supported on a long pole extended down into the swimming pool. Initial attempts to automate pool vacuum cleaning included devices doing nothing more than agitating the water sufficiently to place the dirt in suspension with the intention that the dirt would be filtered out by the pool's standard filtration system. With such devices the dirt is not removed from the bottom of the pool, where it naturally settles, but is instead dispersed throughout the swimming pool water where it can be irritating and harmful to swimmers. Other prior art pool cleaning devices have included relatively complex switching mechanisms to reverse or alter the direction of movement of the devices on the pool floor while being substantially inoperative in pools having irregular shape and such devices have been incapable of climbing steep pool floor surfaces and pool walls.

In U.S. Pat. No. 3,229,315, granted to B. H. Watson, there is disclosed a vacuum-type pool cleaning device including a housing supported on four wheels, two of which are power-driven and mounted on a pivotal yoke. The yoke has an off-center drive so that it will pivot when an obstruction (pool wall) is encountered thereby turning the device and permitting it to move about the pool bottom in a random pattern. The housing is connected through a hose to the pool's water circulating pump inlet so that water, and hence the dirt, is drawn directly from the bottom of the pool. The water is conducted through a hydraulic motor in the housing where it rotates an impeller that serves as the power source for turning the driven wheels mounted on the pivotal yoke.

In U.S. Pat. No. 4,449,265, granted to J. S. Hoy, there is disclosed a vacuum powered swimming pool cleaner including a housing enclosing a reversible water driven impeller having a shaft and drive sprocket which is interconnected by drive belts to at least one pair of reversible drive wheels. As water is drawn through the impeller housing it is directed by a directional control flange through alternative paths to cause the impeller to rotate in a clockwise or counter-clockwise direction thereby driving the pool cleaner device forwardly or rearwardly. The control flange is operated by a sliding directional control actuator bar which projects forwardly from the cleaner device in its direction of travel. When the cleaner device engages the side of the pool the control bar is pushed to a position at which it moves the control flange to change the path of water flow and reverse the rotational direction of the impeller and thus the direction of rotation of the drive wheels and the direction of movement of the cleaner device.

It is an object of the present invention to provide an improved vacuum powered automatic swimming pool cleaning device.

It is a further object of the invention to provide a vacuum powered swimming pool cleaning device with four wheel drive which is adapted to travel underwater along a random path on the bottom of a swimming pool.

It is another object of the invention to provide a vacuum powered swimming pool cleaner which rapidly reverses its direction of travel upon encountering a vertical pool wall or another object stopping its path of travel.

It is yet another object of the invention to provide a vacuum powered swimming pool cleaning device that is capable of climbing the walls of the pool and upon reaching the surface of the water reversing its ascent travel mode to a decent travel mode to the bottom of the pool to again take a random path of travel across the bottom of the pool until another wall is reached for climbing.

It is still another object of the invention to provide a vacuum powered swimming pool cleaning device that will cover all areas of a pool floor and the pool walls without attention by an operator.

Other objects and advantages of the invention will become apparent from the following summary and detailed description of the invention taken in conjunction with the accompanying drawing figures.

SUMMARY OF THE INVENTION

The present invention relates to an improved vacuum powered automatic swimming pool cleaning device with positive four wheel drive, rapid reversal of the direction of travel upon encountering a vertical pool wall or obstructive object, random path of underwater travel on the pool floor for maximum floor cleaning coverage, and the capability of climbing the walls of the pool for wall cleaning coverage. The pool cleaning device is comprised essentially of a hollow four-section housing supported on two pairs of device mover wheels (each wheel pair mounted to an axle) with the wheel pairs interconnected by a first gear train for common and like drive action. The housing further includes, in a central portion thereof, a suction chamber enclosing a turbine wheel which rotates in one direction by the force of water drawn through the suction chamber by the pool's water circulating pump, interconnected thereto by a hose with a swivel housing connector.

The axle of the turbine wheel bears a drive gear which is interconnected to one of the pairs of device mover wheels (driven mover wheels) by a second power transmission gear train. The second gear train includes, at its end for drive interaction with the turbine drive gear, intermeshed first and second shift (transmission) gears which provide forward and reverse rotation to the driven mover wheels and thereby forward and reverse movement of the pool cleaning device. The first and second shift gears are mounted (in their intermeshed orientation) on a transmission pivot plate which positions one or the other of such gears into drive relationship with the turbine drive gear based upon shifting of the pivot plate as directed by one of a pair of interconnected pivoted floats located within the housing of the pool cleaning device on each side thereof. The floats are interconnected through a single pivot shaft so that their position within the housing (outboard of the first gear train interconnecting the mover wheels and the power transmission gear train interconnected to the driven mover wheels) is synchronized.

The housing of the pool cleaning device of the invention bears at each end a guarding wheel located over the center of gravity of the device. The guarding wheels each rotate freely on an axle supported on an outwardly and upwardly projecting arm. When the cleaning device nears a pool wall in its forward or rearward moving direction one of the guarding wheels makes first contact therewith and lifts the device so that climbing of the wall by the device may be effected. Each guarding wheel may also act as a moving wheel if the cleaning device is toppled to an end position. The device rapidly rights itself from such an end position because of its low center of gravity. Wall climbing by the cleaning device is accomplished by the combination of the power drive of the four mover wheels and the suction of water through the device by the turbine wheel holding the device to the wall.

Mounted centrally on each axle of the pairs of mover wheels is a freely rotating stabilizing wheel which is of slightly smaller diameter than the mover wheels. The purpose of the stabilizing wheels is to assist the pool cleaning device in traveling over uneven pool floor surfaces and small objects that may rest on the pool floor. Mounted centrally on each side of the housing of the device, and projecting outwardly therefrom, is a freely rotating guide wheel which maintains the device and its mover wheels free of direct side contact with pool walls. If the cleaning device is toppled to its side a guide wheel acts as a mover wheel until the device rights itself because of its low center of gravity.

The pool cleaning device of the invention also includes a random travel mechanism, located proximate the base of the housing, which consists of an "L" shaped lift member (including a long lift leg and a shorter stop arm) pivoted to a rotating disk mounted on a small spur gear driven by the first gear train interconnecting the pairs of mover wheels. As the cleaning device moves across the pool floor in one direction the lift member of the random travel mechanism is rotated in inoperative fashion (lift leg out of contact with the pool floor) by the rotating disk driven by its associated spur gear. When the cleaning device interacts with an object which causes a reversal of its direction of travel (reversal of rotation of the mover wheels), the lift member rotates in an opposite direction (counter to the direction of mover wheel rotation) and the lift leg thereof is cyclically projected and oriented downwardly to interact with the pool floor to lift the mover wheels of the device on the side proximate the first gear train out of contact with the floor and thereby skew the direction of travel of the device resulting in a random path of travel of the device.

BRIEF DESCRIPTION OF THE DRAWING FIGURES

FIG. 1 is side elevation view of the vacuum powered automatic swimming pool cleaning device of the present invention showing the housing of the device, a front and rear mover wheel, the guarding or bumper wheels situated on their outwardly and upwardly projecting arms, the top swivel connector for attachment of a water suction hose to the device, and a guide wheel centrally located on the housing;

FIG. 2 is a bottom plan view of the pool cleaning device of FIG. 1 showing the bottom of the housing with part lines defining its four sections thereof, the positions of the pairs of mover wheels of the device, a stabilizing wheel on the axle of each pair of mover wheels, the upper guarding wheels and the side guide wheels, a water suction trough and water entry port, and the random travel mechanism;

FIG. 3 is a side elevation view of the rear side of the pool cleaning device of FIG. 1, taken on line 3—3 of FIG. 4, with the outer housing section removed to show the first gear train interconnecting the axles of the two pairs of mover wheels and the random travel mechanism, the float on the opposite side of the device, within the housing, being shown in phantom outline;

FIGS. 3*a*–3*e* show in schematic presentation a sequence of the operation of the random travel mechanism of the pool cleaning device with respect to the direction of movement of the device;

FIG. 4 is a sectional view of the pool cleaning device of FIG. 1 taken along line 4—4 of FIG. 3;

FIG. 5 is an enlarged partial side elevation view of the front side of the pool cleaning device of FIG. 1 with the outer housing section removed to show the second gear train of the device interacting with the turbine drive gear intermeshed with a first shift (transmission) gear of the gear train to drive the interconnected mover wheel in a clockwise direction, the turbine wheel being illustrated in phantom outline in clockwise rotation and the float on the opposite side of the device, within the housing, also being shown in phantom outline in its position causing the turbine drive gear to intermesh with the first shift gear;

FIG. 6 is an enlarged partial side elevation view of the front side of the pool cleaning device of FIG. 1 with the outer housing section removed to show the second gear train of the device interacting with the turbine drive gear intermeshed with the second shift (transmission) gear of the gear train to drive the interconnected mover wheel in a counter-clockwise direction, the turbine wheel being illustrated in phantom outline in clockwise rotation and the float on the opposite side of the device, within the housing, also being shown in phantom outline in its position causing the turbine drive gear to intermesh with the second shift gear; and FIGS. 7–11 are side elevation views of the pool cleaning device of the present invention showing in sequence: the movement of the device along the floor of a pool, the device in climbing approach to a wall of the pool; the device in climbing movement up the wall of the pool; the device in partial emergence from the pool; and the device in descending movement down the wall of the pool, each figure showing in phantom outline the position of the internal floats controlling the direction of movement of the device.

DETAILED DESCRIPTION OF THE INVENTION

Figure 1:
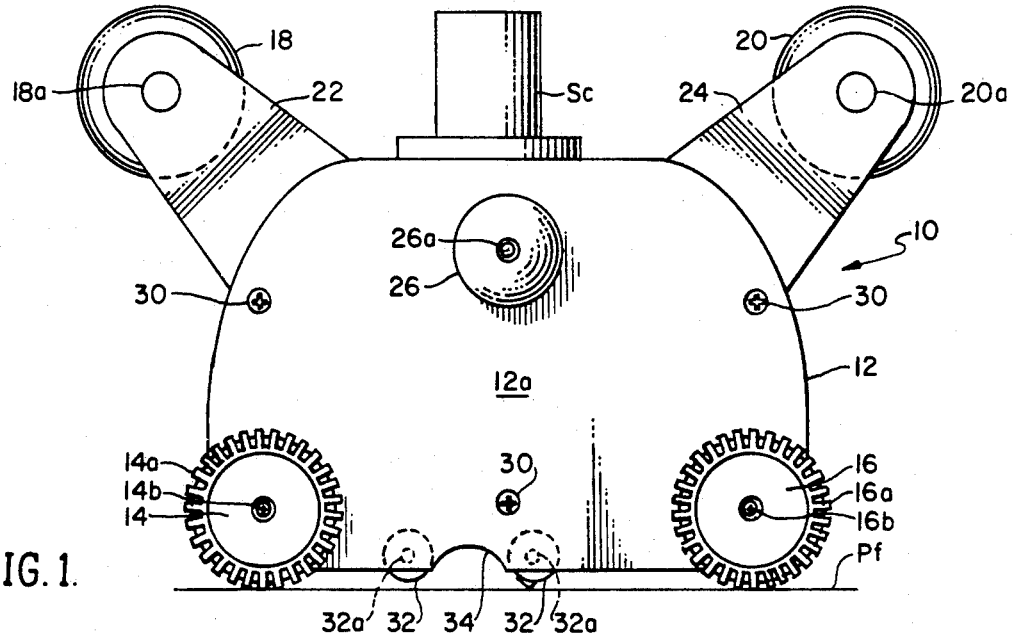

Referring now to the drawing figures, there is illustrated a preferred embodiment of the vacuum powered automatic swimming pool cleaning device of the present invention. The numeral 10 designates in general the assembled pool cleaning device. As shown in the FIG. 1 side elevation view, the pool cleaning device 10 is comprised of a housing 12 having lower supporting mover wheels 14 and 16, guarding or bumper wheels 18 and 20 supported, respectively, on outwardly and upwardly projecting pairs of arms 22 and 24, a side guide wheel 26, and a swivel mounted hose connector Sc. The mover wheels 14 and 16 bear rubber treading (treads 14*a* and 16*a*, respectively) and are maintained affixed to their respective axles by bolts 14*b* and 16*b*, respectively. The bumper wheels 18 and 20 rotate freely with their respective supporting axles 18*a* and 20*a*. The housing 12 of the pool cleaner is formed of four plastic molded housing sections 12*a*–12*d* with only section 12*a* being viewed in FIG. 1. The housing sections are maintained in their assembled position by a multiplicity of assembly screws 30 of which three are shown in FIG. 1. Also shown in the figure are centrally positioned housing support wheels 32 which are free to rotate on their axles 32*a* should they come in contact with the pool floor or a pool wall. The support wheels 32 straddle the water suction trough 34 through which water is drawn into a central port leading to the suction chamber of the pool cleaning device which encloses a turbine wheel as described hereinafter.

Figure 2:
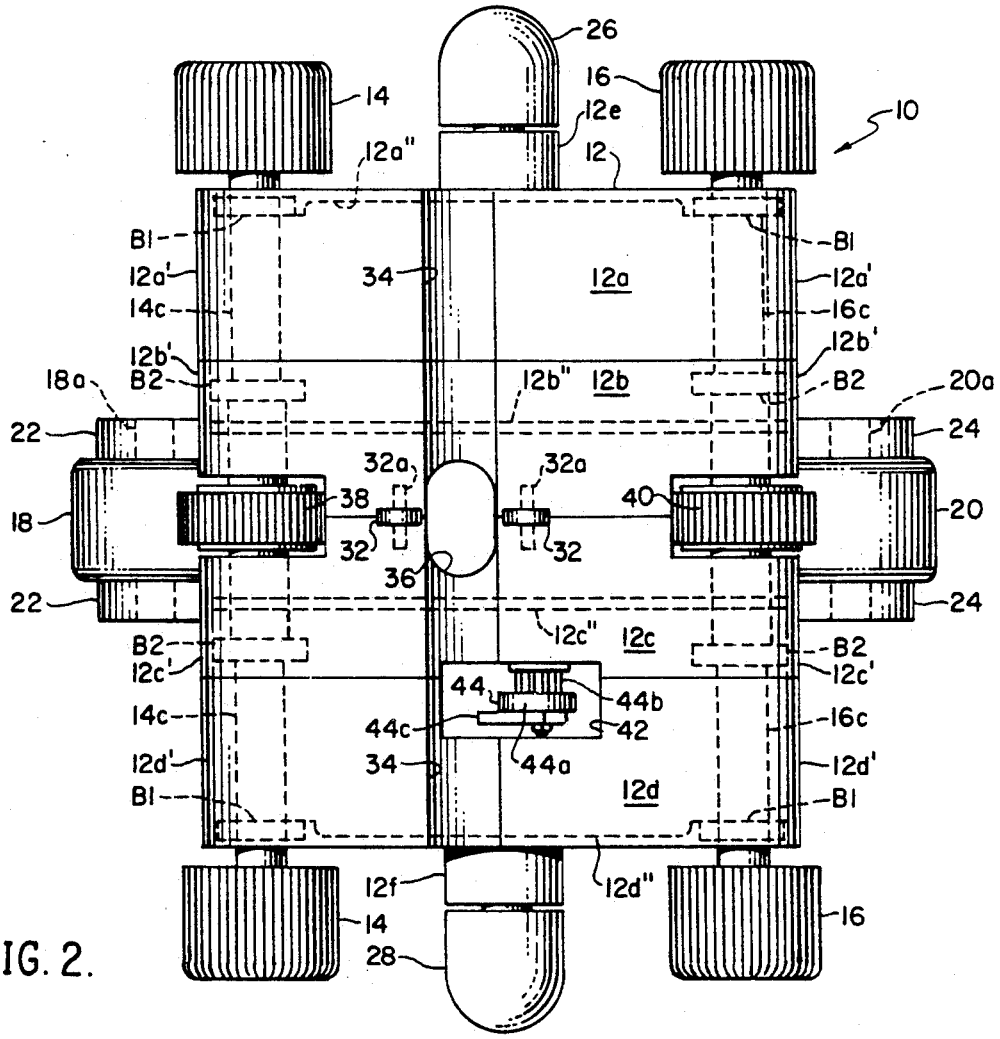

FIG. 2 is a bottom plan view of the pool cleaning device 10 of FIG. 1 showing the orientation of the four housing sections 12*a*–12*d* of the device and the pairs of rubber treaded mover wheels 14 and 16 which are positioned outboard of the housing 12 at the ends of their respective axles 14*c* and 16*c*. As previously indicated, the mover wheels are maintained affixed to their respective axles 14*c* and 16*c* by bolt means 14*b* and 16*b*, respectively (see FIG. 4). The pairs of mover wheels 14 and 16 are also pinned to their respective axles 14*c* and 16*c* (see the pin 16*d*, for example, in FIG. 4) so that they rotate together in positive drive fashion as will be discussed hereinafter.

The plastic molded housing sections 12*a*–12*d* each are formed with peripheral walls 12*a*'–12*d*', respectively, with outer housing sections 12*a* and 12*d* having outer end walls 12*a*" and 12*d*", respectively. It is to be noted that the end walls 12*a*" and 12*d*" each include appropriately positioned lower internal recesses into which are positioned bearings B1 (shown in dashed outline) which support the axles 14*c* and 16*c* upon which are mounted the mover wheels 14 and 16. The bearings B1 associated with axle 16*c* may also be seen in FIG. 4. Axle bearings B2 (shown in dashed outline in FIG. 2) provide intermediate support for axles 14*c* and 16*c*. The inner housing sections 12*b* and 12*c* have cross walls 12*b*" and 12*c*", respectively, which together define the water suction chamber C of the pool cleaning device 10 within which is located a turbine wheel T (see FIGS. 4–6).

FIG. 2 also shows the central position of the upper guarding or bumper wheels 18 and 20 (fabricated of solid plastic material) supported on their respective projecting pairs of arms 22 and 24 by their free rotating axles 18*a* and 20*a*. The pairs of wheel supporting arms 22 and 24 are formed as an integral molded part of peripheral walls 12*b*' and 12*c*' of the central plastic molded housing sections 12*b* and 12*c*.

The side guide wheels 26 and 28 are mounted to wheel mounts 12*e* and 12*f* which are integral molded outward projections of the end walls 12*a*" and 12*d*", respectively, of the outer housing sections 12*a* and 12*d*, respectively. The guide wheels 26 and 28 are maintained in free rotating position on their respective wheel mounts 12*e* and 12*f* by retaining bolts 26*a* (not visible) and 28*a* (as seen in FIG. 4).

Mounted centrally on the mover wheel axles 14*c* and 16*c* are freely rotating treaded stabilizing wheels 38 and 40 which are slightly smaller diameter than mover wheels 14 and 16. The purpose of the stabilizing wheels is to assist the pool cleaning device in traveling over uneven pool floor surfaces and small objects that may rest on the pool floor.

In FIG. 2 the water suction trough 34 is shown to span the entire housing asssembly 12. Intermediate the ends of trough 34 (in housing sections 12*b* and 12*c*) there is formed a central port 36 which opens into the suction chamber of the pool cleaner 10 and through which water is drawn to drive the turbine wheel located within such chamber. Also seen in FIG. 2 through a port 42 formed in housing sections 12*c* and 12*d*, is a bottom view of the random travel mechanism 44 of the pool cleaning device. This mechanism (comprised of disk 44*a* mounted to a small spur gear 44*b* and carrying an "L" shaped lift member 44*c*) will be further described and discussed hereinafter.

Figure 3:
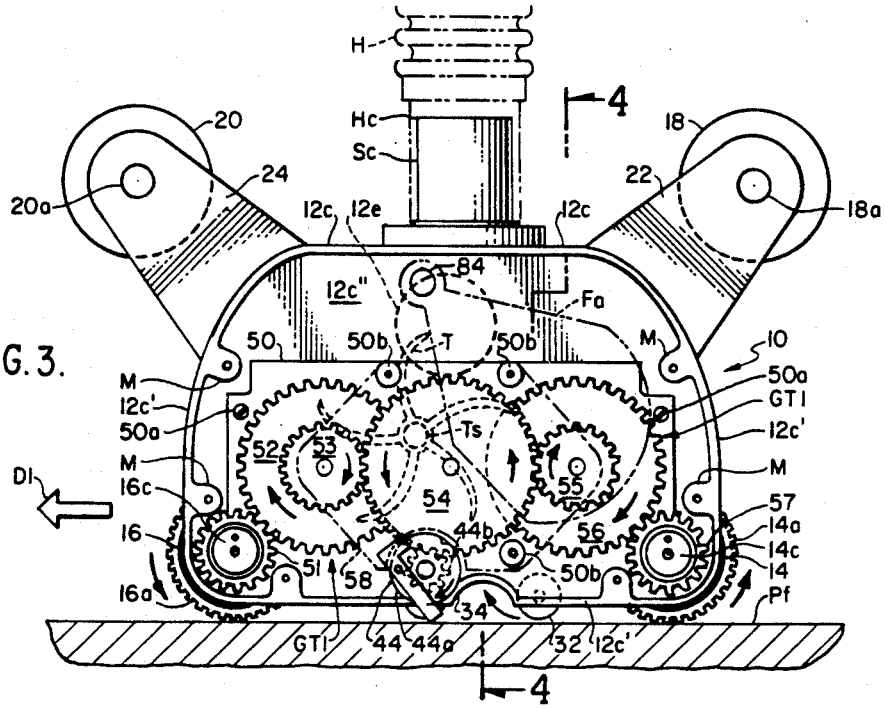
Figure 4:
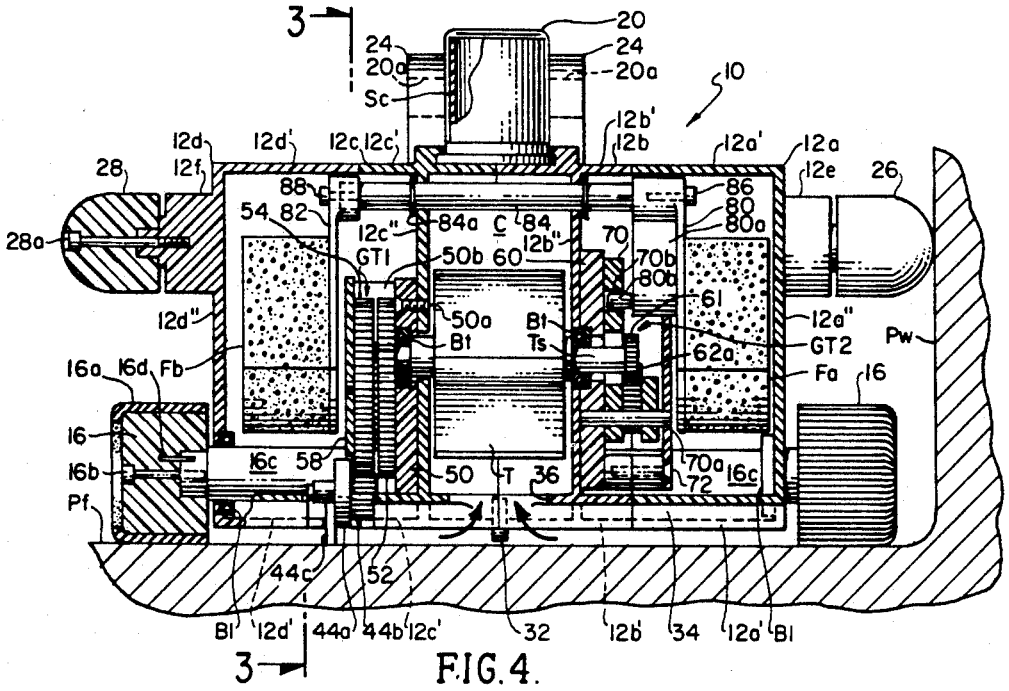
Figure 7:
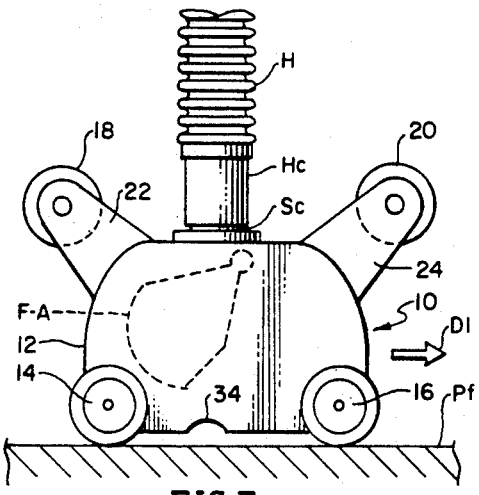

Referring now to FIG. 3, there is shown a side elevation view of the rear side of the pool cleaning device 10 of FIG. 1, taken on line 3—3 of FIG. 4, with the outer housing section 12*d* removed to show a first gear train GT1 interconnecting the axles of the two pairs of mover wheels and the random travel mechanism 44. The float Fa on the opposite side of the device, within the housing section 12*a*, is shown in phantom outline. Also shown in phantom outline is the turbine wheel T supported on its shaft Ts within the water suction chamber C (see also FIGS. 4–6).

The first gear train GT1 is supported within intermediate housing section 12*c* on mounting plate 50 which is affixed to the outboard side of wall 12*c*" of such housing section. This gear train transfers drive power from driving axle 14*c* of the drive wheels 14 to the driven axle 16*c* of the drive wheels 16 and includes: axle drive gear 51 (affixed to axle 16*c* interconnecting drive wheels 16 of the pool cleaning device 10); power transfer gear 52 (intermeshed with axle drive gear 51) and spur gear 53 affixed to the axle of gear 52; power transfer gear 54 (intermeshed with spur gear 53); spur gear 55 intermeshed with intermediate power transfer gear 54 and affixed to the axle of power transfer gear 56; and axle drive gear 57 (affixed to axle 14*c* interconnecting drive wheels 14 of the cleaning device 10). The intermediate power transfer gear 54 also drives spur gear 44*b* of the random travel mechanism 44. The power transfer gears and spur gear components of gear train GT1 are maintained in their intermeshed alignment on their respective axles by a gear train cover plate 58 shown in phantom outline on FIG. 3. The gear train mounting plate 50 is affixed to the wall 12*c* of the intermediate housing section by screws 50*a* and the cover plate 58 is held to and positioned on the mounting plate 50 by cover plate mounts 50*b* and associated screws (not shown).

The random travel mechanism 44 (comprised of disk 44*a* mounted to spur gear 44*b* and "L" shaped lift member 44*c*) as shown in FIG. 3 is being driven clockwise by spur gear 44*b* (intermeshed with intermediate power transfer gear 54 of gear train GT1) with the longer lift leg of the lift member being dragged along the pool floor Pf by the pool cleaning device 10 which (as illustrated) is moving from right to left. The purpose of the random travel mechanism is to periodically lift drive wheels 14 and 16 on the side of the pool cleaning device proximate the random travel mechanism off of the pool floor and thereby cause a skewing of the direction of travel of the device so that the pool cleaning device moves in a random path across the pool floor.

To further illustrate the operation of the random travel mechanism 44 of the invention, there is presented in FIGS. 3*a*– 3*e* a series of motion figures showing the positions and functions of the components of the mechanism based upon the direction of travel of the pool cleaning device 10. In each of the figures the mechanism 44 includes disk 44a and the "L" shaped lift member 44c with the driving spur gear 44b of the mechanism not illustrated. The disk 44a and associated spur gear 44b are affixed to shaft 44d (projects outwardly from the face of the disk) and the "L" shaped lift member 44c (includes elongated lift leg portion 44c' and shorter stop arm portion 44c'') is pivoted to disk 44a by pin 44e. As the pool cleaning device 10 moves across the pool floor Pf in a right to left direction as shown in FIG. 3 and in motion FIGS. 3a and 3b the disk 44a of the mechanism rotates in a clockwise direction and the lift member 44c is rotated with the disk and with the elongated lift leg portion 44c' of the lift member in contact with the outwardly projecting portion of shaft 44d. With each clockwise rotation of disk 44a the elongated lift leg portion 44c' of the lift member is merely dragged across the pool floor and does not perform a lift function.

Figures 3A, 3B, 3C, 3D, 3E:
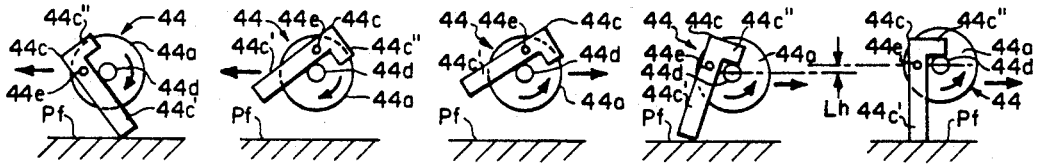

When the pool cleaning device 10 reaches a pool wall, or other obstruction on the floor of the pool, the internal floats Fa and Fb of the device swing to a reversing position thereby causing the device (as described in detail hereinafter) to reverse its direction of movement across the pool floor and, as shown in motion FIGS. 3c-3e, the disk 44a of the random travel mechanism 44 commences to rotate in a counter-clockwise direction. As the disk 44a rotates in such direction the shorter stop arm portion 44c'' of the lift member 44c moves into stop contact with the outwardly projecting portion of shaft 44d (see motion FIG. 3d) and the elongated lift leg portion 44c' of the lift member contacts the pool floor Pf in a non-drag position. With further rotation of the disk 44a the lift leg portion 44c' of the lift member lifts the random travel mechanism 44 a lift height distance Lh (see motion FIG. 3e) and thereby lifts the entire pool cleaning device (on the side of the device proximate the random travel mechanism) whereby the drive wheels 14 and 16 proximate the mechanism are removed from driving contact with the pool floor. With the drive wheels on one side of the cleaning device out of contact with the pool floor for an instant, the cleaning device pivots slightly on the lift leg portion 44c' of the mechanism from its former direction of travel and thereby has its path of travel skewed. This periodic action of the random travel mechanism provides a unique random path of travel for the pool cleaning device of the invention.

In FIG. 3 there is also further illustrated the position of the water suction trough 34 at the bottom of the pool cleaning device 10 and the swivel mounted hose connector Sc of the device at the top thereof. The position of the bumper wheels 18 and 20 and their respective support arms 22 and 24 is also shown and housing section mounts M are illustrated.

Referring now to FIG. 4, there is shown a sectional view of the pool cleaning device 10 of FIG. 1 taken along line 4—4 of FIG. 3. The figure clearly shows the arrangement of the four housing sections 12a-12d, the pair of driver wheels 16 mounted on their axle 16c, and the side guide wheels 26 and 28 mounted, respectively, to wheel mounts 12e and 12f which comprise molded outward projections of end walls 12a'' and 12d'' of the housing sections 12a and 12d. The figure also shows the position of the first gear train GT1 (including its mounting plate 50 and cover plate 58) with its mounting plate 50 affixed to the outboard side of cross wall 12c'' of inner housing section 12c. A second gear train GT2 (the power transmission gear train as will be described hereinafter with respect to its further illustration in FIGS. 5 and 6) is shown with its mounting plate 60 affixed to the outboard side of cross wall 12b'' of the inner housing section 12b. Also, as will be described hereinafter, the second gear train is controlled in its direction of rotation by a transmission shift plate 70 which is rotatable on pivot shaft 70a. Power transmission gear train GT2 is protected by a cover plate 72.

Continuing with reference to FIG. 4, the cross walls 12b'' and 12c'' of the inner housing sections 12b and 12c, respectively, define the water suction chamber C of the pool cleaning device 10 of the invention. The upper portions of peripheral walls 12b' and 12c' of housing sections 12b and 12c, respectively, include an opening (not shown) from the suction chamber C to the swivel hose connector Sc. The lower portions of peripheral walls 12b' and 12c' of housing sections 12b and 12c include a central port 36 which provides water access to the water suction chamber C from the water suction trough 34 which spans the bottom of the pool cleaning device from side-to-side.

Positioned centrally within the water suction chamber C is turbine wheel T supported therein by turbine shaft Ts which in turn is supported by turbine bearings Bt on each side of the turbine wheel. The turbine bearings are mounted to the mounting plate 50 of gear train GT1 and to the mounting plate 60 of gear train GT2. The turbine shaft Ts is shown to extend beyond the bearing Bt situated in mounting plate 60 and such shaft bears at its projected end turbine drive gear 61 which provides the rotary driving force to power transmission gear train GT2 as will be described in reference to FIGS. 5 and 6. The turbine wheel T is rotated by water which is suctioned through the pool cleaning device 10 through water suction trough 34 and central port 36 into the suction chamber, through the suction chamber, thence out of the suction chamber through the swivel hose connector Sc, and through a water suction hose H (not shown) to the inlet of a water circulating pump (also not shown).

Within the compartment formed between end wall 12a'' of outer housing section 12a and cross wall 12b'' of the inner housing section 12b there is housed a first pivoted float Fa which is positioned outboard of the power transmission gear train GT2. Within the compartment formed between end wall 12d'' of outer housing section 12d and cross wall 12c'' of inner housing section 12c there is housed a second pivoted float Fb which is positioned outboard of the first gear train GT1. The floats Fa and Fb are affixed, respectively, to float arms 80 and 82 and the float arms (at their upper ends) are interconnected to one-another by a connecting rod 84.

The positions of the floats Fa and Fb within their respective compartments are maintained by rod clips 84a on each outer side of cross walls 12b'' and 12c''. The float arms 80 and 82 are keyed to the ends of rod 84 and they are maintained attached to rod 84 via lock bolts 86 and 88, respectively. Thus, the floats Fa and Fb (of substantially tear-drop configuration) are maintained in parallel swing alignment within their respective compartments. The float arm 80 includes an inwardly extending portion 80a from which there projects a transmission pin 80b. The transmission pin 80b projects into a shift channel 70b of the pivoted transmission plate 70 and interacts with such channel to shift the transmission plate as directed by the position of Floats Fa and Fb within the housing 12 of the pool cleaning device 10 as described hereinafter with reference to FIGS. 5 and 6.

Referring now to FIG. 5 there is illustrated, in an enlarged partial side elevation view, the pool cleaning device 10 of FIG. 1 with the outer housing section 12*a* removed to show the second gear train GT2 (the power transmission gear train) of the device interacting with the turbine drive gear 61 (affixed to the shaft Ts of the turbine wheel T) intermeshed with a first shift (transmission) gear 62*a* of the gear train. The turbine wheel T is shown in dashed outline behind cross wall 12*b*" of housing section 12*b*. The turbine housing Th is also shown in dashed outline in the figure. The first shift (reversing) gear 62*a* is in permanent mesh with the second shift (reversing) gear 62*b* with both of these shift gears mounted on pivoted transmission plate 70. The second shift gear 62*b* intermeshes with a first drive gear 63 which has mounted (in fixed fashion) on its axle a first spur gear 64. Spur gear 64 intermeshes with a second drive gear 65 which has mounted (in fixed fashion) on its axle a second spur gear 66. Spur gear 66 intermeshes with a third drive gear 67 which intermeshes with drive gear 68 mounted to the axle 14*c* of the pair of wheels 14 of the pool cleaning device.

As the turbine wheel T rotates in the clockwise direction as shown in FIG. 5, the turbine drive gear 61 rotates clockwise and drives the first shift gear 62*a* in a counter-clockwise direction and the intermeshed second shift gear 62*b* in a clockwise direction. The second shift gear 62*b* thence drives the remainder of the drive gears and spur gears of the gear train GT2 in fixed sequence whereby the mover wheels 14 of the pool cleaning device rotate in a positive clockwise direction. The mover wheels 16 are also driven in the same positive clockwise direction by the first gear train GT1 of the device. It is to be noted that, as shown in FIG. 5, the float Fb (shown in phantom outline) has swung to a position at the left end of the cleaning device 10. The interconnected and parallel float Fa would (if visible) be in the same position. The transmission pin 80*b* of the float arm 80 of float Fa is positioned as shown in FIG. 5 and the transmission plate 70 is pivoted via the pin 80*b* action with respect to the shift channel 70*b* of such plate.

As shown in FIG. 5 the pool cleaning device 10 of the invention is moving from left to right by the clockwise rotation of the mover wheels 14 and 16. When the device impacts an obstruction, such as a vertical pool wall, the floats Fa and Fb of the device are immediately shifted (or thrown) to the position shown in phantom outline in FIG. 6 and the transmission pin 80*b* of the float arm 80 of float Fa moves through shift channel 70*b* to rotate and position the transmission plate 70 as shown in such figure. In such position the transmission plate 70 has shifted the position of the first and second transmission gears 62*a* and 62*b* so that the second transmission gear 62*b* (and not the first transmission gear 62*a*) intermeshes with turbine drive gear 61 with gear 62*b* remaining in intermeshed relationship with the first drive gear 63. Thus, with the turbine wheel T still rotating in the same clockwise direction (its only direction of rotation), the drive gears and spur gears of the drive train GT2 rotate in reverse direction (see FIG. 6), the mover wheels 14 and 16 rotate in a counter-clockwise direction and the pool cleaning device 10 of the invention moves from right to left.

In FIGS. 5 and 6 there is also further illustrated the position of the water suction through 34 at the bottom of the pool cleaning device 10. Housing mounts M are also illustrated and the positions of assembly screws 76 are indicated. Further, in FIG. 5 the mounts 74 (on the gear train mounting plate 60) for the transmission cover 72 are shown and in both FIGS. 5 and 6 the housing support wheels 32 are shown. In FIG. 6 the gear train mounting plate 60 has not been shown so that an understanding of the operation of the second gear train GT2 is simplified.

Figure 8:
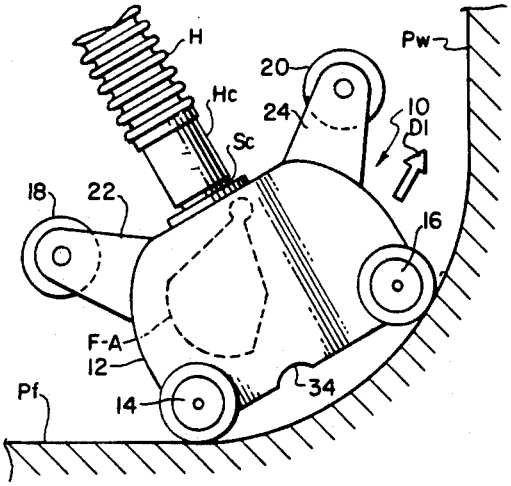
Figure 9:
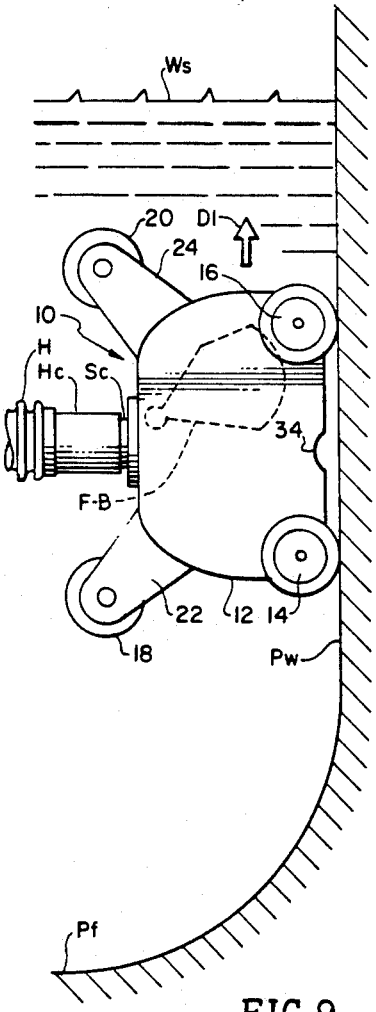
Figure 10:
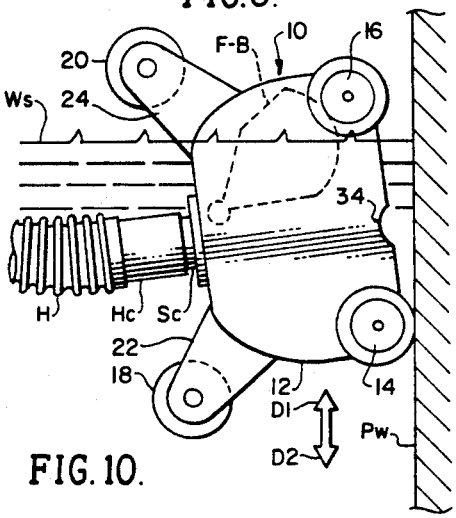
Figure 11:
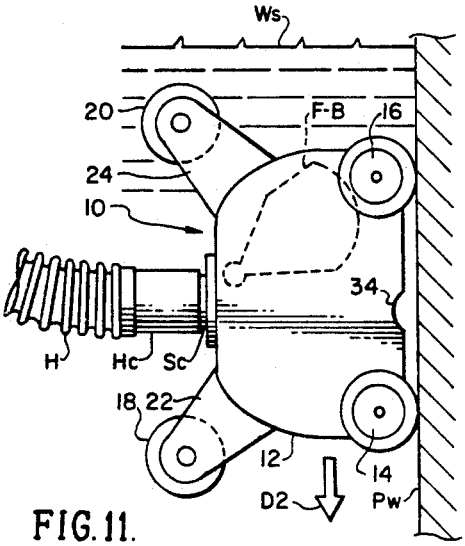

FIGS. 7–11 are side elevation views of the pool cleaning device of the present invention showing in sequence: 1) the movement of the device 10 along the pool floor Pf (FIG. 7); 2) the device 10 in climbing approach (via a curved intersection of the pool floor and the pool wall) to a wall Pw of the pool (FIG. 8); 3) the device 10 in climbing motion and movement up the wall Pw of the pool (FIG. 9); 4) the device 10 at the point of reverse motion after the device has attained partial emergence from the pool after breaking the water surface Ws (FIG. 10); and 5) the device 10 in descending motion and movement down the pool wall Pw toward the pool floor (FIG. 11). It is to be noted that in FIGS. 7–8 the internal float pair Fa-Fb controlling the direction of movement of the pool cleaning device is in a rearward orientation F-A with the device moving in a forward direction D1. In FIG. 9 the buoyancy of the float pair has moved same to a near forward orientation F-B (the internal reversing gears have not yet shifted) and in FIGS. 10 and 11 the internal float pair Fa-Fb (controlling the direction of movement of the device) has reached its full forward orientation F-B (with its internal reversing gears shifted) with the device moving in a rearward direction D2.

During operation of the vacuum-type swimming pool cleaning device of the present invention, the device 10 is immersed into and located on the bottom (floor) of a swimming pool. Pool water enters and fills the device via central port 36 (opens into the water suction chamber C) and by ports (not shown) which are appropriately located in the peripheral walls 12*a*' and 12*d*', respectively, and end walls 12*a*" and 12*d*", respectively, of the housing sections 12*a* and 12*d*. Upon full water immersion of the pool cleaning device 10, the internal float pairs Fa-Fb move upwardly within the device to the position shown in either FIG. 5 or FIG. 6. The device 10 is interconnected (via swivel connector Sc) through a water suction hose to the inlet of a water circulating pump. As water is drawn through the central port 36 at the bottom of the device (proximate the mid-point of the suction trough 34) and through the suction chamber C, which houses turbine wheel T, it engages the vanes of the turbine wheel thereby rotating such wheel in a fixed and constant direction as shown in FIGS. 5 and 6, i.e., the turbine wheel always turns in the same direction.

The suction of water along the length of the water suction trough 34 (spans the width of the pool cleaning device 10) and into the port 36 leading to the water suction chamber C creates a vacuum effect under the device with the result that dirt and debris on the pool floor is pulled into the cleaning device, passes through the suction chamber, and is transported with the water through the water suction hose to a filter system associated with the circulating pump that creates the water suction effect. The small housing support wheels 32 on each side of the suction trough 34 (midway of the width of the pool cleaning device) are provided to assure that the floor portions of the housing sections are sucked into direct contact with the pool floor by the water suction action in trough 34 created by the circulating pump thereby causing drag on the movement of the device and frictional wear on the floor portion of the housing.

The rotating turbine wheel T and its affixed turbine drive gear 61 drive the gears of the power transmission gear train GT2 in a rotational direction dictated by whether turbine drive gear 61 is intermeshed with the first shift gear 62*a* (FIG. 5) or with the second shift gear 62*b* of such gear train. The intermeshed position of either shift gear 62*a* or shift gear 62*b*, with respect to the other gears of gear train GT2, is determined by the position of the pair of internal floats Fa and Fb and in turn the rotational position of the transmission shift plate 70. Thus, when these floats are in the position shown in phantom outline in FIG. 5 the gears of gear train GT2 are driven by the turbine gear 61 acting through the first shift gear 62*a* and the gears of the train rotate so as to drive mover wheels 14 in a clockwise direction. When floats Fa and Fb are in the position shown in phantom outline in FIG. 6 the gears of such gear train GT2 are driven by turbine gear 61 acting through the second shift gear 62*b* and the gears of the train rotate so as to drive mover wheels 14 in a counter-clockwise direction.

As the pool cleaning device 10 moves across the pool floor in either of its directions of movement, as powered by mover wheels 14 and 16, the floats Fa and Fb are oriented rearwardly of the direction of movement of the device. When the cleaning device impacts an obstruction on the pool floor or, runs into a vertical wall of the pool, the floats Fa and Fb of the device are suddenly shifted or swung forwardly to their alternative position. This change in the position of the floats shifts the position of the transmission pin 80*b* of the float arm 80 of float Fa in the shift channel 70*b* of the transmission plate 70 with the result that the transmission plate rotates and shifts either shift gear 62*a* or 62*b* into mesh drive arrangement with turbine drive gear 61 and the gear train reverses its rotational drive action on mover wheels 14 and the pool cleaning device reverses its direction of travel.

If the swimming pool, within which the pool cleaning device 10 of the invention is operating, includes pool floor to pool wall transition surfaces having relatively large radii of curvature as shown in FIG. 8 of the drawings, the mover wheels 14 and 16 of the device will propel the device over such transition surfaces and the device commences to climb the pool wall. The suction effect or vacuum force created by the water turbine wheel in drawing water into the device from the water trough 34 maintains the device against the pool wall in its climbing and descending movement along the wall as shown in FIGS. 9, 10 and 11. The buoyancy of the float pair Fa-Fb controlling the direction of rotation of the mover wheels 14 and 16, and thus the direction of movement of the cleaning device, has (as shown in FIG. 9) moved the floats to a near forward orientation F-B. However, the internal reversing (shift gears) have not as yet freed themselves of the position dictating forward movement of the device. As the cleaning device nears the top of the side wall of the pool, and breaks above the water surface Ws as shown in FIG. 10, the internal float system within the device reaches its full swing to its forward orientation F-B and completes the shifting of the reversing gears with the result that the power transmission gear train GT2 reverses the drive rotation of the mover wheels 14 and 16 and the device moves downwardly along the surface of the pool wall. At the top of its journey up the pool wall the cleaning device may tend to swing slightly outward from the wall, as shown in FIG. 10, but as the mover wheels reverse their rotation to commence the downward movement of the device the suction force of the water drawn into the device through the water suction trough pulls the device back into full four-wheel contact with the wall, as shown in FIG. 11.

In its movement across the pool floor, the pool cleaning device of the invention travels in a random path as dictated by the random travel mechanism of the device as described hereinbefore.

The materials of construction of the pool cleaning device preferably include moldable plastics for the housing sections and many of the drive and spur gears. Others of the gears and their shafts may be made of stainless steel or brass. In general the parts of the device must be designed and constructed to withstand a water environment.

In the specification and drawing figures there has been set forth a preferred embodiment of the pool cleaning device of the invention. Although specific terms have been employed in describing the invention, they are used in a generic and descriptive sense only and are not for purposes of limitation, the scope of the invention being defined in the following claims.

What is claimed is:

1. A vacuum powered automatic swimming pool cleaning device for cleaning the bottom and side walls of a swimming pool comprising:

a) a hollow housing supported on two pairs of reversible device mover wheels, said housing including
   i) a central water suction chamber in water flow inlet communication with a water suction trough spanning the bottom of said housing and in water flow outlet communication with an external vacuum line,
   ii) a first outboard chamber containing a first gear train interconnecting said pairs of mover wheels and a first pivoted directional control float, and
   iii) a second outboard chamber containing a second gear train with its power output end positioned to reversibly drive one of said pairs of mover wheels and a second pivoted directional control float coupled to said first float by a common pivot rod traversing the upper portion of said water suction chamber and maintaining said floats in parallel pivot orientation;

b) a turbine wheel bearing water driven vanes and mounted on a turbine shaft operatively disposed and positioned within said water suction chamber whereby with the passage of water through said chamber in contact with said vanes said wheel rotates in a single direction, said turbine shaft extending into the second outboard chamber of said housing and bearing a turbine drive gear;

c) a transmission shift plate pivotally mounted within the second outboard chamber of said housing and bearing first and second shift gears in intermeshed relationship with each other, said second shift gear being in intermeshed drive relationship with a first drive gear at the power input end of said second gear train, said shift plate being pivotal to a first position whereat said first shift gear is intermeshed with said turbine drive gear whereby the gears of said second gear train are driven via said first shift gear through said second shift gear in one rotational direction and pivotal to a second position whereat said second shift gear is intermeshed with said turbine drive gear whereby the gears of said second gear train are driven only by said second shift gear in a reverse rotational direction; and d) means operable by said second pivoted float to move the pivotally mounted transmission shift plate between its first pivotal position and its second pivotal position in response to a swing shift in the position of said coupled first pivoted float and second pivoted float caused by the impact of the pool cleaning device on an obstruction to its path of travel whereby said shift plate reverses the rotational direction of the gears of said second gear train and thereby the direction of rotation of the mover wheels and the direction of travel of the pool cleaning device.

2. A vacuum powered automatic swimming pool cleaning device as claimed in claim 1 wherein the means operable by said second pivoted float to move said transmission shift plate between its first pivotal position and its second pivotal position comprises a transmission pin projecting from said float and interacting with a shift channel in the said shift plate.

3. A vacuum powered automatic swimming pool cleaning device as claimed in claim 1 wherein the pool cleaning device includes bumper wheels mounted on outwardly and upwardly projecting arms at each end of said device whereby upon the contact of one of said bumper wheels with a pool wall said device is lifted by said wheel with the mover wheels at the end of said device of bumper wheel contact removed from the pool floor and with the coupled first pivoted float and second pivoted float shifting their position within said housing to reverse the direction of rotation of the mover wheels of said device and its direction of travel.

4. A vacuum powered automatic swimming pool cleaning device as claimed in claim 1 wherein there is positioned in said first outboard chamber within a port at the bottom of said housing a random travel mechanism including: a rotatable disk having an extended axle; a spur gear mounted to said axle on one side of said disk and rotatable therewith; and an "L" shaped lift member pivotally mounted to said disk on the other side thereof at a point offset from the axle, said spur gear being intermeshed with a gear of said first gear train for driving said disk in a rotational direction opposite to the reversible rotational direction of said mover wheels as directed by said second gear train, said "L" shaped lift member includes an elongated lift leg portion and a shorter stop arm portion whereby as the disk of the random travel mechanism rotates in one direction the lift leg portion of said lift member rides in contact with the extended axle of said disk and said lift leg portion is dragged with each revolution of said disk across the bottom wall of the swimming pool whereas when the disk of the random travel mechanism rotates in a reverse direction the stop arm portion of said lift member rides in contact with the extended axle of said disk and the lift leg portion contacts the bottom wall of the swimming pool with each revolution of said disk and lifts the mover wheels on the side of the pool cleaning device proximate said random travel mechanism out of driving contact with the bottom wall of the swimming pool thereby skewing the direction of travel of the pool cleaning device and creating a desired random path of travel for said device.

5. A vacuum powered automatic swimming pool cleaning device as claimed in claim 1 wherein the hollow housing of the pool cleaning device is formed of four plastic molded housing sections each having mating peripheral walls, said housing including two outer housing sections each having an outer end wall and two inner housing sections each having a cross wall, the cross walls of said inner housing sections together defining the central water suction chamber of said device, and the cross wall of each inner housing section defining with the outer end wall of its contiguous outer housing section an outboard chamber of said device.

6. A vacuum powered automatic swimming pool cleaning device for cleaning the bottom and side walls of a swimming pool comprising:

a) a hollow housing supported on two pairs of reversible device mover wheels, said housing including i) a central water suction chamber in water flow inlet communication with a water suction trough spanning the bottom of said housing and a water flow outlet at the top of said chamber in communication with a water circulation suction pump through an external vacuum line, ii) a first outboard chamber containing a first gear train interconnecting said pairs of device mover wheels and a first pivoted directional control member floatable to a first position and a second position within said chamber, and iii) a second outboard chamber containing a second gear train with a power output end positioned to reversibly drive one of said pairs of device mover wheels and a second pivoted directional control member floatable to a first position and a second position within said chamber and coupled to said first directional control member by a common pivot rod traversing the upper portion of said water suction chamber and maintaining said control members in parallel orientation;

b) a turbine wheel bearing water driven vanes and mounted on a turbine shaft operatively disposed and positioned within said water suction chamber whereby with the passage of water through said chamber in contact with said vanes said wheel rotates in a single direction, said turbine shaft extending into the second outboard chamber of said housing and bearing a turbine power output drive gear;

c) a transmission shift plate pivotally mounted within the second outboard chamber of said housing and bearing first and second shift gears in intermeshed relationship with each other, said second shift gear being in intermeshed drive relationship with a first drive gear at the power input end of said second gear train, said shift plate being pivotal to a first position whereat said first shift gear is intermeshed with said turbine output drive gear whereby the gears of said second gear train are driven via said first shift gear through said second shift gear in one rotational direction and to a second position whereat said second shift gear is intermeshed with said turbine output drive gear whereby the gears of said second gear train are driven only by said second shift gear and in a reverse rotational direction; and d) means operable by said second pivoted directional control member to move the pivotally mounted transmission shift plate between its first pivotal position and its second pivotal position in response to a swing shift in the position of said coupled first pivoted directional control member and second pivoted directional control member caused by the impact of the cleaning device with an obstruction or vertical pool wall in its path of travel whereby said shift plate changes its pivotal position reversing the rotational direction of the gears of said second gear train and thereby the direction of rotation of the device mover wheels and the direction of travel of the pool cleaning device.

7. A vacuum powered automatic swimming pool cleaning device as claimed in claim 6 wherein the two pairs of reversible device mover wheels which support the housing of said device bear rubber treads whereby said wheels display maximum traction with respect to the bottom and side walls of the swimming pool.

8. A vacuum powered automatic swimming pool cleaning device as claimed in claim 6 wherein said device upon encountering a curved intersection of the bottom and side walls of the swimming pool traverses said intersection by the traction power of the two pairs of reversible device mover wheels and climbs the side wall of said pool by said traction power with the suction force of the water drawn from the suction trough at the bottom of said device and through the water suction chamber thereof by said turbine wheel maintaining said device in contact with the side wall of the pool.

9. A vacuum powered automatic swimming pool cleaning device as claimed in claim 8 wherein as said device climbs the side wall of said pool the buoyancy of said coupled first and second pivoted directional control members causes said members to swing shift their position within said outboard chambers whereby the transmission shift plate is pivoted to a point near which the first and second shift gears shift their position to reverse their drive relationship with the first drive gear at the power input end of said second gear train.

10. A vacuum powered automatic swimming pool cleaning device as claimed in claim 9 wherein said device upon climbing the side wall of said pool and breaking the surface of the water of said pool is reversed in its direction of travel by a further swing shift in the position of said coupled first and second pivoted directional control members with a resulting reversal in the direction of rotation of said device mover wheels for descending movement on said side wall with the suction force of the water drawn from the suction trough at the bottom of said device and through the water suction chamber by said turbine wheel maintaining said device in contact with the side wall of the pool.

11. A vacuum powered automatic swimming pool cleaning device for cleaning the bottom and side walls of a swimming pool comprising:

a) a hollow housing supported on two pairs of drive interconnected device mover wheels, said housing including
   i) a central water suction chamber in water flow inlet communication with a water suction trough at the bottom of said housing and in water flow outlet communication with an external vacuum line,
   ii) a gear train with its power output end positioned to reversibly drive one of said pairs of mover wheels, and
   iii) pivoted directional control float means;

b) a turbine wheel bearing water driven vanes and mounted on a turbine shaft operatively disposed and positioned within said water suction chamber whereby with the passage of water through said chamber in contact with said vanes said wheel rotates in a single direction, said turbine shaft bearing a turbine power output drive gear;

c) a transmission shift plate pivotally mounted within said housin and bearing first and second shift gears in intermeshed relationship with each other, said second shift gear being in intermeshed drive relationship with a first drive gear at the power input end of said gear train, said shift plate being pivotal to a first position whereat said first shift gear is intermeshed with said turbine drive gear whereby the gears of said gear train are driven via said first shift gear through said second shift gear in one rotational direction and pivotal to a second position whereat said second shift gear is intermeshed with said turbine drive gear whereby the gears of said gear train are driven only by said second shift gear in a reverse rotational direction; and d) means operable by said pivotal float means to move said transmission shift plate between its first pivotal position and its second pivotal position in response to a swing shift in the position of said float means within said housing caused by the impact of the pool cleaning device on an obstruction to its path of travel whereby said shift plate reverses the rotational direction of the gears of the gear train and thereby the direction of rotation of the pairs of interconnected device mover wheels and the direction of travel of the pool cleaning device.

12. A vacuum powered automatic swimming pool cleaning device as claimed in claim 11 wherein the means operable by said pivotal float means to move said transmission shift plate between its first pivotal position and its second pivotal position comprises a transmission pin projecting from said float means and interacting with a shift channel in said shift plate.

13. A vacuum powered automatic swimming pool cleaning device as claimed in claim 11 wherein the pool cleaning device includes bumper wheels mounted at each end of said device whereby upon the contact of one of said bumper wheels with a vertical pool wall said device is lifted by said wheel with the mover wheels at the end of said device of bumper wheel contact removed from the pool floor and with said pivoted float means shifting its position within said housing to reverse the direction of rotation of the mover wheels of said device and its direction of travel on the pool floor.

14. A vacuum powered automatic swimming pool cleaning device as claimed in claim 11 wherein said device upon encountering a curved intersection of the bottom and side walls of the swimming pool traverses said intersection by the traction power of the two pairs of drive interconnected device mover wheels and climbs the side wall of said pool by said traction power with the suction force of the water drawn from the suction trough at the bottom of said device and through the water suction chamber thereof by said turbine wheel maintaining said device in contact with the side wall of the pool.

15. A vacuum powered automatic swimming pool cleaning device as claimed in claim 14 wherein as said device climbs the side wall of said pool the buoyancy of said pivoted float means causes said float means to swing shift its position within said housing whereby the transmission shift plate is pivoted to a point near which the first and second shift gears shift their position to reverse their drive relationship with the first drive gear at the power input end of said gear train.

16. A vacuum powered automatic swimming pool cleaning device as claimed in claim 15 wherein said device upon climbing the side wall of said pool and breaking the surface of the water of said pool is reversed in its direction of travel by a further swing shift in the position of said float means with a resulting reversal in the direction of rotation of said device mover wheels for descending movement on said side wall with the suction force of the water drawn from the suction trough at the bottom of said device and through the water suction chamber by said turbine wheel maintaining said device in contact with the side wall of the pool.

* * * * *